US009676573B2

(12) United States Patent
Rietbergen et al.

(10) Patent No.: US 9,676,573 B2
(45) Date of Patent: Jun. 13, 2017

(54) SHEET HANDLING APPARATUS WITH ROTARY DRUM

(71) Applicant: OCÉ-TECHNOLOGIES B.V., Venlo (NL)

(72) Inventors: Mark Rietbergen, Venlo (NL); Antonius G. H. Albers, Venlo (NL); Gerardus J. C. Van Soest, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/933,731

(22) Filed: Nov. 5, 2015

(65) Prior Publication Data

US 2016/0137442 A1 May 19, 2016

(30) Foreign Application Priority Data

Nov. 17, 2014 (EP) ..... 14193517

(51) Int. Cl.
*B65H 5/02* (2006.01)
*B65H 5/22* (2006.01)
(Continued)

(52) U.S. Cl.
CPC ..... *B65H 5/226* (2013.01); *B65H 29/243* (2013.01); *B65H 29/56* (2013.01); *B65H 2301/3122* (2013.01); *B65H 2301/4461* (2013.01); *B65H 2301/5143* (2013.01); *B65H 2301/5144* (2013.01); *B65H 2401/15* (2013.01); *B65H 2406/33* (2013.01); *B65H 2406/3612* (2013.01);
(Continued)

(58) Field of Classification Search
CPC ..... B65H 2406/33; B65H 2406/3612; B65H 2406/3622; B65H 5/226; B65H 29/243
See application file for complete search history.

(56) References Cited

U.S. PATENT DOCUMENTS 2,033,849 A * 3/1936 Mudd ..... B65C 1/023 118/236
4,145,040 A 3/1979 Huber
(Continued)

FOREIGN PATENT DOCUMENTS

JP 62-59660 U 4/1987
JP 2010-126269 A 6/2010

*Primary Examiner* — Howard Sanders
(74) *Attorney, Agent, or Firm* — Birch, Stewart, Kolasch & Birch, LLP

(57) ABSTRACT

A sheet handling apparatus comprising a rotary drum having an outer peripheral wall with perforations, and a number of separate chambers, a suction system for controlling a flow of air through the perforations, thereby to attract sheets to the peripheral wall of the drum, and a stationary shutter member for blocking the flow of air through the perforations when they pass through a predetermined angular range. The number of separate chambers extend in axial direction and are distributed over the periphery of the drum. A disk-shaped manifold at the first axial end of the drum is co-rotatably with the drum. The manifold forms a number of radial channels each connected to one of said chambers and having an opening at a radially inward end of each channel. The stationary shutter member is arranged for blocking an opening of a channel to block air flow from a radially inward end of a channel.

13 Claims, 5 Drawing Sheets

(51) Int. Cl.
*B65H 29/24* (2006.01)
*B65H 29/56* (2006.01)

(52) U.S. Cl.
CPC ..... *B65H 2406/3614* (2013.01); *B65H 2406/3622* (2013.01); *B65H 2801/06* (2013.01)

(56) References Cited

U.S. PATENT DOCUMENTS

| | | | | |
|---|---|---|---|---|
| 5,226,870 | A * | 7/1993 | Smith | B65H 29/243 271/195 |
| 5,855,710 | A * | 1/1999 | Hinton | B65C 3/16 156/215 |
| 2002/0129687 | A1 * | 9/2002 | Eckstein | B26D 7/018 83/26 |
| 2010/0206485 | A1 | 8/2010 | Kodera | |

* cited by examiner

SHEET HANDLING APPARATUS WITH ROTARY DRUM

FIELD OF THE INVENTION

The invention relates to a sheet handling apparatus comprising:

- a rotary drum having an outer peripheral wall with perforations formed therein, wherein the perforated wall of the drum delimits a number of separate chambers that extend inside the drum,
- a suction system for controlling a flow of air through the perforations of the drum, thereby to attract sheets to the peripheral wall of the drum; and
- a stationary shutter member for blocking the flow of air through the perforations when they pass, with the rotation of the drum, through a predetermined angular range.

DESCRIPTION OF THE INVENTION

Background Art

A sheet handling apparatus of this type has been described in JP 2010126269 A and may be used for conveying media sheets in a printer or copier, for example. When the sheets are attracted to the peripheral wall of the drum and the drum rotates, the sheets are conveyed in circumferential direction of the drum. As the sheets come into intimate contact with the peripheral wall of the drum, the heat conductivity of that wall may be utilized for controlling the temperature of the sheets, i.e. for heating or cooling them. The stationary shutter member has the purpose to interrupt the flow of air through the perforations at a specific angular position, so that the sheets can be detached from the drum more easily when they reach that position.

In the known apparatus, the shutter member is a plate that is disposed inside the drum and is held in slide-sealing contact with the internal surface of the perforated peripheral wall, so that the perforations are covered and blocked by the plate when they move through the angular range where the plate is disposed.

When the dwell time of the sheets on the surface of the drum has to be extended in order to increase the time that is available for the heat exchange, it is necessary to increase the diameter of the drum. In that case, the known apparatus has the drawback that the seal between the shutter member and the peripheral wall of the drum will give rise to an increased frictional resistance and/or to an increased leakage of air.

In an apparatus with a large drum, it has therefore been preferred to use a segmented drum having a plurality of chambers distributed over the periphery of the drum, and a suction system that includes a plurality of valves for individually controlling the suction pressure in each of these chambers, so that the sheets can be released from the surface of the drum by closing the valves at appropriate timings. However, the large number of valves leads to increased costs and an increased risk of failure.

In the prior art, a rotary drum is generally formed of a solid material or a single 'block' of material. The separate chambers below the outer circumferential wall of the drum are then cut-out from said material, while channels are bored into the drum to provide air flow to said chambers. Such drums are generally heavy and their production is costly and lengthy. The weight is especially a drawback in an apparatus with a large drum, wherein the control of the large drum is difficult due the drum's large inertia. Further, the energy consumption for driving such a heavy drum is high.

SUMMARY OF THE INVENTION

It is an object of the invention to provide a drum-type sheet handling apparatus that avoids the drawbacks of the prior art as discussed above.

In order to achieve this object, according to the invention, the apparatus of the type mentioned in the opening paragraph is characterized in that the number of separate chambers extend in axial direction from a first axial end of the drum to a second axial end of the drum and are distributed over the periphery of the drum, a disk-shaped manifold is mounted at the first axial end of the drum co-rotatably with the drum, which manifold forms a number of radial channels each of which has an outer end connected to one of said chambers and each of which has an opening at a radially inward end of each channel, and the stationary shutter member is arranged for blocking the opening of a channel to block air flow from a radially inward end of a channel to the suction system.

Thus, the apparatus according to the invention utilizes a segmented drum, but instead of having a plurality of valves, the suction system comprises a manifold mounted on an axial end of the drum, which manifold rotates together with the drum and forms a number of channels that extend radially inwardly from the respective chambers towards the axis of the drum. The shutter member is arranged to block openings at the inward ends of each channel and, consequently, is also disposed relatively close to the axis of the drum. As a result, the speed of the openings at the inner ends of the manifold channels relative to the stationary shutter member is significantly smaller than the speed with which the sheets are conveyed at the outer periphery of the drum. Consequently, the shutter member may be tightly sealed against the manifold without the energy losses caused by friction at the seal becoming too large. Moreover, as the shutter member is disposed at a relatively small radius, the dimensions of the seal are reduced, which further reduces the frictional forces, and the torque that is caused by these frictional forces and opposes the driving torque for the drum is reduced even more because the shorter radius at which the seal is disposed will reduce the leverage. In addition, the reduced dimensions of the shutter member and its seal will reduce the risk and/or amount of leakage.

In comparison to an apparatus with a plurality of valves, the invention has the further advantage that valve switching noises are avoided.

Additionally, by providing the disk-shaped manifold at an axial end of the drum, the drum and the manifold may be formed of relatively thin or light weight materials, reducing the weight and costs of the apparatus. The reduced weight advantageously allows for an easier control of the drum as well as a reduction in energy consumption for driving the drum. Further, in an apparatus according to the present invention the manifold may be formed separately from the drum and mounted onto the drum later to simplify the production of the apparatus.

More specific optional features of the invention are indicated in the dependent claims.

The manifold may be disposed inside of the drum and may extend over the entire length of the drum. In a preferred embodiment, however, the manifold and, consequently, also the shutter member are significantly smaller than the drum in axial direction, which helps to save costs and weight and to further reduce the amount of friction. If necessary, a plurality of manifolds may be distributed over the length of the drum, in order to assure a uniform evacuation of the chambers at the periphery of the drum.

In another attractive embodiment, the manifold or manifolds are disposed outside of the drum at one or both axial ends thereof. In that case, the openings at the inner ends of the manifold channels may face in axial direction of the drum towards the mouth of a suction pipe leading to the suction system. Then, the shutter member may simply be formed by a plate that extends in a plane normal to the axis of rotation of the drum and engages the internal part of the manifold where the openings of the channel are formed. For improved sealing, this plate may be biased elastically against the manifold.

According to a further development of the invention, the shutter member may include an air supply system for introducing air into those channels of the manifold through which are to be shut-off. This permits to reduce a possible residual vacuum that could otherwise be caused by incomplete sealing between the channel openings and the suction system that must be connected to the openings of neighbouring channels. Optionally, air may be blown actively into some of the manifold channels via the shutter member so as to actively blow-off the leading edges of the sheets from the surface of the drum.

In an embodiment, the openings at the radially inward ends of the channels are disposed adjacent an axis of the drum. Further, the shutter member may be positioned adjacent and/or near an axis of the drum. The axis may be formed by a rotation axis of the drum, for example an axle. Thereby, the shutter member may be disposed relatively close to or near by the axis of the drum, reducing frictional forces.

In an embodiment, the apparatus further comprises a ring element or ring extending circumferentially around an axis of the drum. Said ring preferably encloses the axis of the drum. The ring element comprises a substantially circumferentially extending window aligned with the openings at the radially inwards ends of the channels. Air may then pass from the openings through the window to e.g. a vacuum source. The window forms a circumferential passage or channel parallel to the drum axis, through which window air may flow. The window preferably substantially encloses the axis. The shutter member is positioned in the window and is thus arranged for blocking or closing an angular range of the window. The shutter member closes part of the window. Air is then able to flow through the passage of the window, except in the location where the shutter member has been provided. Basically, the window defines a circumferential passage, wherein a predefined angular range of the window is closed or blocked by the shutter member. The window may, in an embodiment, extend around the axis for the majority of a turn, e.g. an almost complete turn, for example 350°. The remainder of the turn is occupied by the shutter member. For the remaining 10°, that region or part of the window is closed off by the shutter member. As such, a angular region of the radially or circumferentially extending window is interrupted by the shutter member, locally preventing air flow.

It will be appreciated that within the scope of the present invention a drum according to the present invention may be provided on both sides of a disk-shaped manifold according to the present invention. Thereby, only a single manifold disk in between the two drums is required for supplying a suction force to both drums. Further, an apparatus according to the present invention may be formed of multiple manifold disks and drums according to the present invention, which disks and drums are provided alternately in the axial direction of the drum.

BRIEF DESCRIPTION OF THE DRAWINGS

Embodiment examples will now be described in conjunction with the drawings, wherein.

DETAILED DESCRIPTION OF THE DRAWINGS

Figure 1:
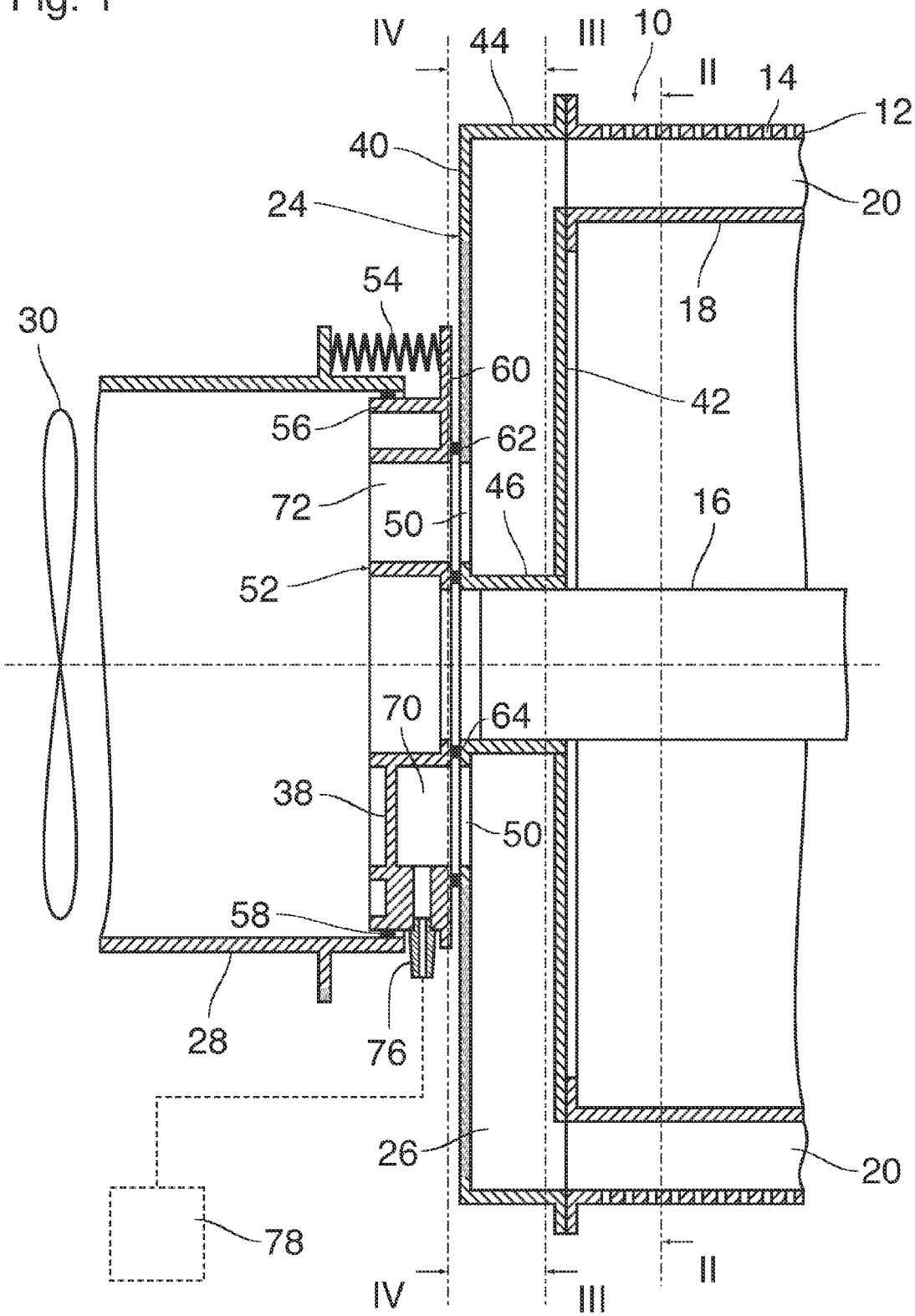
FIG. 1 is a view of a sheet handling apparatus according to the invention in an axial sectional view.

FIG. 1 shows a sheet handling apparatus which comprises a rotary drum 10 that has an outer peripheral wall 12 with perforations 14 formed therein. The drum 10 is mounted on a axle 16 that may be driven for rotation. The outer peripheral wall 12 together with an inner peripheral wall 18, delimits a number of chambers 20 that extend over the entire axial length of the drum. The channels 20 are distributed over the periphery of the drum 10 and are separated from one another by radial walls 22, as can be seen in FIG. 2.

As is shown in FIG. 1, a disk-like manifold 24 is attached to at least one axial end of the drum 10 and forms a plurality of radial channels 26 that connect each of the chambers 20 to a suction pipe 28 that, together with a blower 30, forms a suction system for drawing-in ambient air through the perforations 14 of the peripheral wall 12 of the drum.

Figure 2:
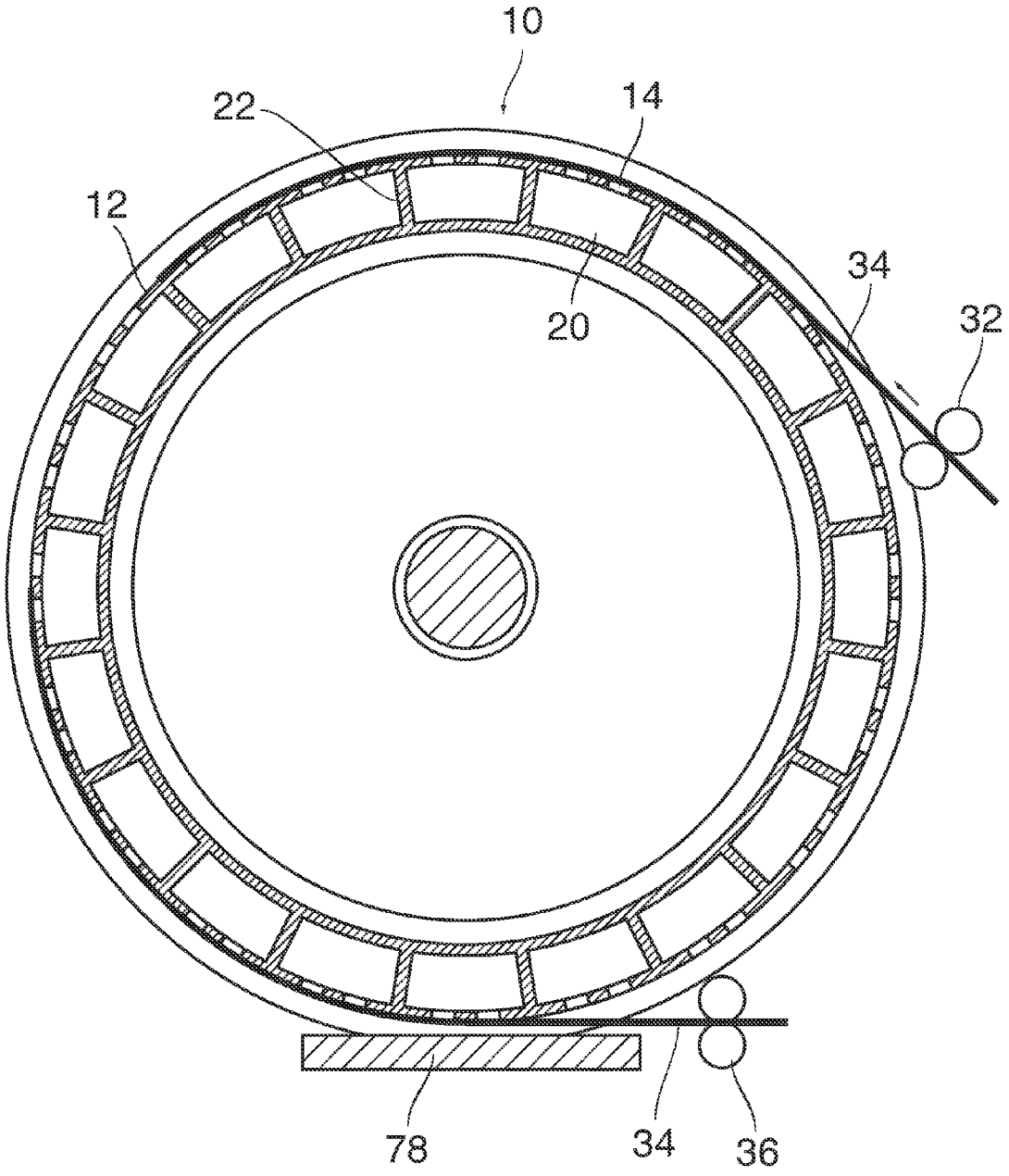
FIG. 2 is a cross-sectional view taken along the line II-II in FIG. 1.

As has been illustrated in FIG. 2, the sheet handling apparatus further comprises a pair of feed rollers 32 arranged to feed sheets 34, e.g. media sheets in a printer, onto the outer surface of the peripheral wall 12 of the drum 10, where the sheets are attracted by the air that is drawn in through the perforations 14.

As the drum 10 rotates counter-clockwise in FIG. 2, the sheets 34 are conveyed around the drum while being held in intimate contact with the peripheral wall 12.

The drum 10 is made of a material with a high thermal conductivity, e.g. of metal, so that the sheets 34 may be cooled by dissipating heat via the drum. The larger the diameter of the drum 10, the more intense is the cooling effect that can be achieved for given conveying speed.

When the leading edge of a sheet reaches a release position, in this example at the lower apex of the drum, it is detached from the drum and conveyed further by means of another roller pair 36.

In order for the sheet 34 to be easily detached from the surface of the peripheral wall 12, the suction effect should be removed or at least reduced in the angular range of the release position.

To that end, as can be seen in FIG. 1, a stationary shutter member 38 is disposed between an inner peripheral portion of the manifold 24 and the end of the suction pipe 28 in the angular range, where the suction effect is to be reduced.

The manifold 24 is configured as a hollow disk with parallel end walls 40, 42, an outer peripheral wall 44 and an inner peripheral wall 46. The outer peripheral wall 44 is flanged to an end of the outer peripheral wall 12 of the drum 10, and the inner peripheral wall 46 connects the two end walls 40 and 42.

Figure 3:
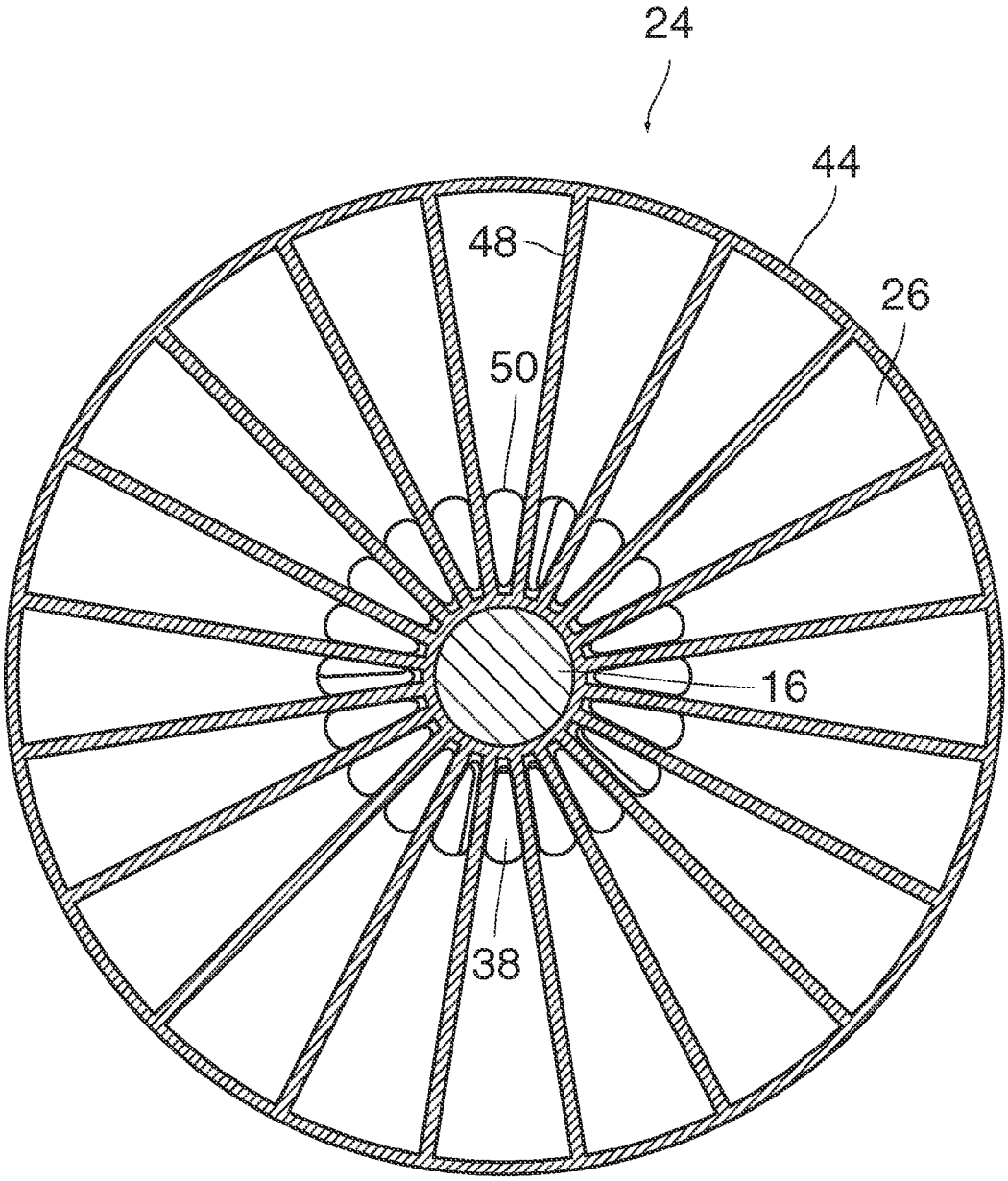
FIG. 3 is a cross-sectional view taken along the line III-Ill in FIG. 1.

As is shown in FIG. 3, the space between the end walls 40 and 42 is divided into the channels 26 by radial walls 48. At the radially inward end of each channel 26, the end wall 40 defines an opening 50 via which the corresponding channel can communicate with the interior of the suction pipe 28. However, some of the openings 50 in an angular range right below the axle 16 in FIG. 3 are blocked by the shutter member 38.

Turning to FIG. 1 again, the shutter member 38 forms part of a ring 52 that is biased against the end wall 40 of the manifold 24 by springs 54. A cylindrical part 56 of the ring 52 is sealed against the inner surface of the suction pipe 28 with an annular seal 58, and a flange part 60 of the ring 52 is sealed against the manifold 24 by two annular seals 62, 64 that are disposed radially outwardly and inwardly, respectively, of the corona of openings 50.

Figure 4:
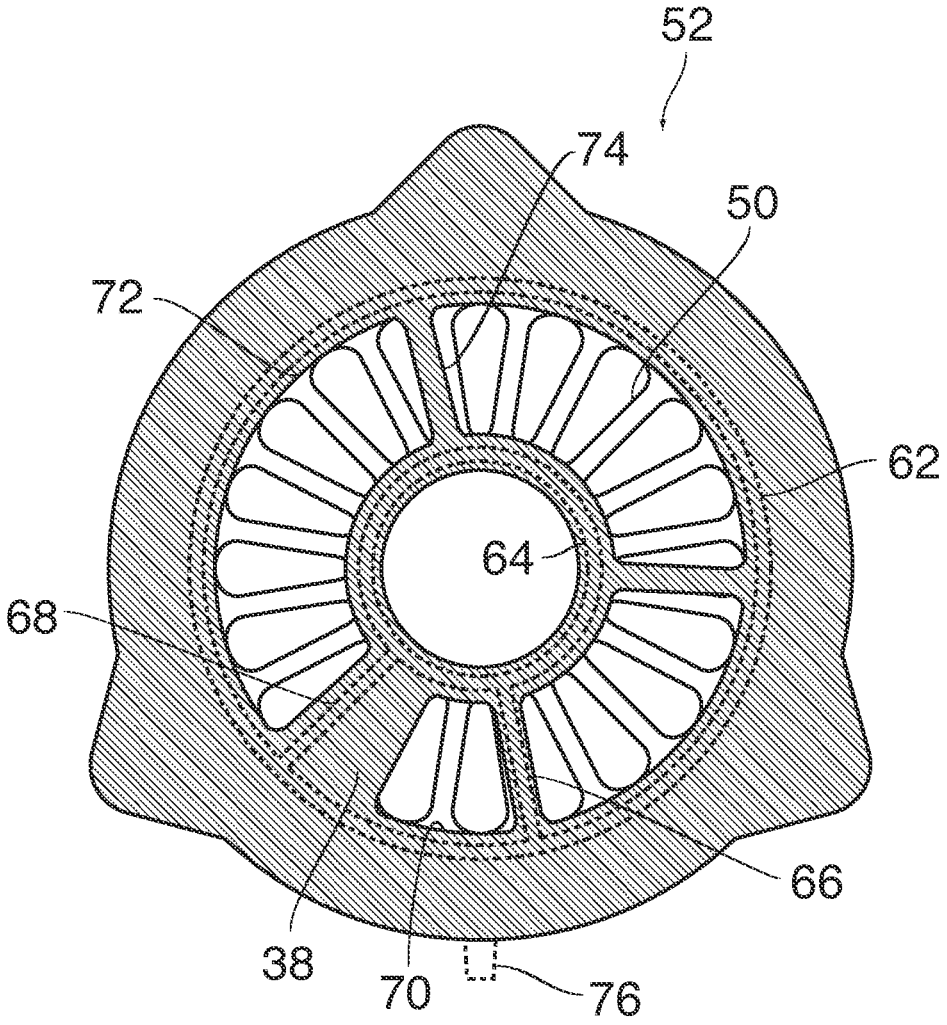
FIG. 4 is a cross-sectional view taken along the line IV-IV in FIG. 1.

In FIG. 4, the seals 62 and 64 have been shown in phantom lines. These two seals are interconnected by radial seal strips 66 and 68 that seal against the shutter member 38 and delimit the angular range in which the air flow through the openings 50 is blocked.

As can be seen in FIGS. 1 and 4, the shutter member 38 has a recessed part 70 facing the manifold 24. As the plane (IV-IV) in which the sectional view in FIG. 4 is taken passes through the flange part 60 of the ring 52, some of the openings 50 are visible in FIG. 4 through the opening of the recessed part 70. Yet, as will be understood from FIG. 1, these openings are blocked by the bottom of the recessed part 70.

Outside of the shutter member 38, the ring 52 has arcuate windows 72 that are separated by narrow spokes 74 and establish fluid communication between the openings 50 of the manifold and the interior of the suction pipe 28.

The recessed part 70 of the shutter member 38 is connected to a port 76 that permits to vent the interior of the recessed part 70 to the atmosphere. This will assure that no suction pressure is introduced into the channels 26 that are presently connected to the recessed part 70, even when the seals 62 and 64 do not completely seal this recessed part against the vacuum in the windows 72.

If desired, it is also possible to use the port 76 for introducing air from a pressure source 78 with a pressure slightly above the atmospheric pressure into the recessed part 70 and into the channels 26 and chambers 20 connected thereto, so that air will be blown out through the perforations 14 in order to assist in separating the sheet 34 from the surface of the drum 10 (FIG. 2). A guide plate 78 is arranged to safely guide the separated sheet 34 into the nip between the rollers 36.

Figure 5:
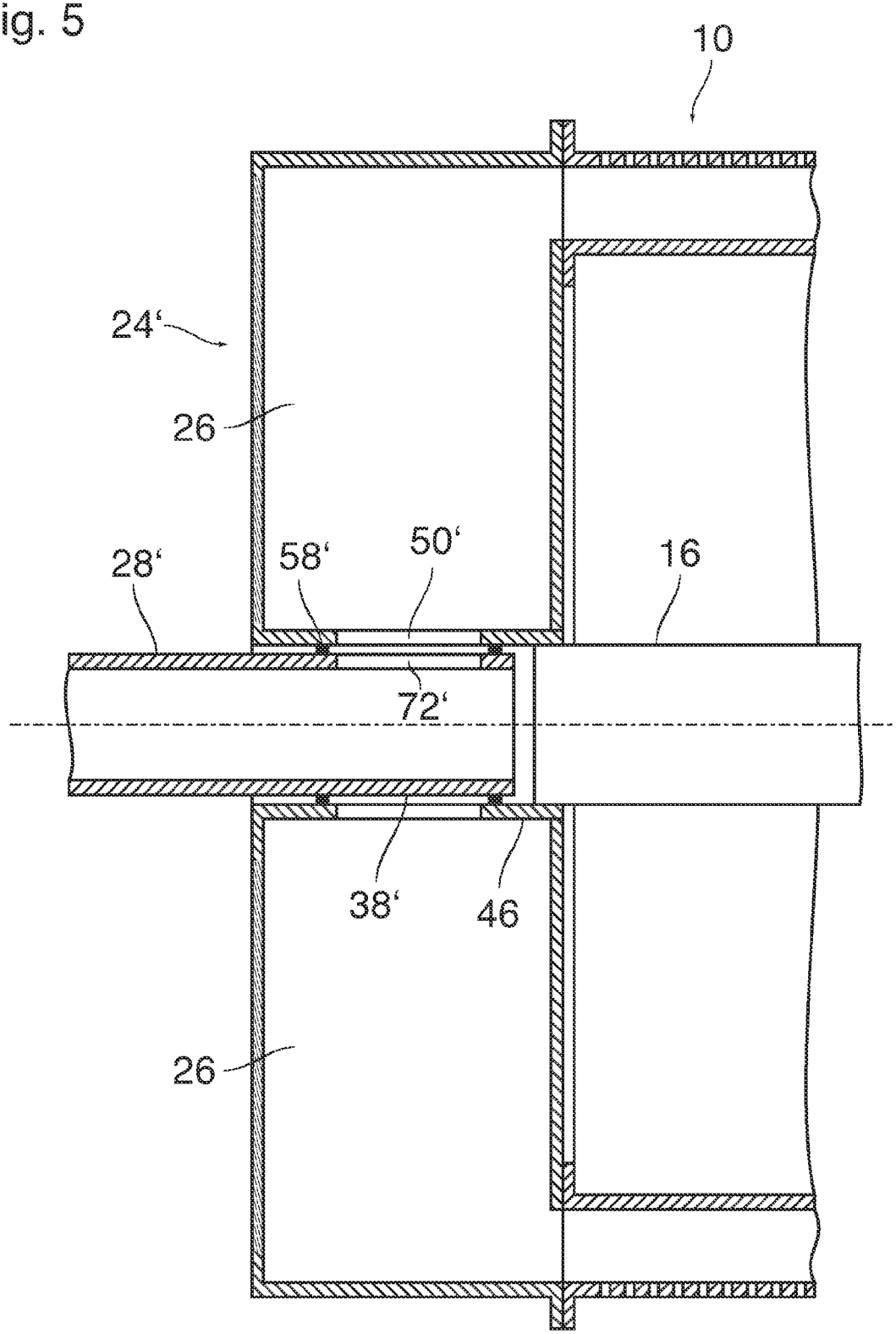
FIG. 5 is an axial section, similar to FIG. 1, but illustrating a modified embodiment.

FIG. 5 illustrates a modified embodiment having a manifold 24', wherein openings 50' that connect the channels 26 to a suction pipe 28' are formed in the inner peripheral wall 46 of the manifold. An end portion of the suction pipe 28' projects into the manifold and is sealed against the inner peripheral wall 46 with two seal rings 58' between which windows 72' are formed in the wall of the suction pipe 28. The shutter member 38' is simply formed by a part of the wall of the suction pipe 28' where the windows 72' have been omitted.

This embodiment may be modified such that the axle 16 is omitted and the suction pipe 28' extends further into the drum 10 and serves as a shaft on which the manifold 24 and the drum 10 are rotatably supported. In that case, the manifold 24 could also be formed inside the drum 10, i.e. between the two axial ends thereof, or it might as well extend over the entire length of the drum 10, so that each chamber 20 would directly merge into the corresponding channel 26.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A sheet handling apparatus comprising:

a rotary drum having an outer peripheral wall with perforations formed therein, wherein the perforated wall of the drum delimits a number of separate chambers that extend inside the drum in axial direction from a first axial end of the drum to a second axial end of the drum and are distributed over the periphery of the drum;

a suction system for controlling a flow of air through the perforations of the drum, thereby to attract sheets to the peripheral wall of the drum;

a stationary shutter member for blocking the flow of air through the perforations when they pass, with the rotation of the drum, through a predetermined angular range; and a disk-shaped manifold mounted at the first axial end of the drum co-rotatably with the drum, which manifold forms a number of radial channels each of which has a radially outer end connected to one of said chambers and each of which has an opening at a radially inward end of each channel, wherein the stationary shutter member is arranged for blocking an opening of a channel to block air flow from a radially inward end of a channel to the suction system.

2. The apparatus according to claim 1, wherein the openings at the radially inward ends of the channels are arranged to open-out in axial direction of the drum and the shutter member slidably engages an end wall of the manifold in which the openings are formed.

3. The apparatus according to claim 2, wherein the shutter member forms part of a ring that is fitted to an end of a suction pipe of the suction system.

4. The apparatus according to claim 2, wherein the shutter member is elastically biased against the end wall of the manifold.

5. The apparatus according to claim 1, wherein the openings at the radially inward ends of the channels are formed in an inner peripheral wall of the manifold that surrounds a portion of a suction pipe of the suction system, and the shutter member is formed by a part of the wall of the suction pipe.

6. The apparatus according to claim 1, wherein the openings are disposed adjacent an axis of the drum.

7. The apparatus according to claim 1, wherein the shutter member has a recessed portion that is open towards the openings of the manifold and is further connected to a port for introducing air into the recessed portion.

8. The apparatus according to claim 7, further comprising a pressure source for introducing compressed air into the recessed part.

9. The apparatus according to claim 1, further comprising a ring element extending circumferentially around an axis of the drum, which ring element comprises a circumferentially extending window aligned with the openings, wherein the shutter member is positioned in the window for closing an angular range of the window.

10. The apparatus according to claim 1, wherein the radial channels are separated from one another by radial walls.

11. The apparatus according to claim 1, wherein the disk-shaped manifold is configured as a hollow disk with parallel end walls, an outer peripheral wall, and an inner peripheral wall.

12. The apparatus according to claim 11, wherein the outer peripheral wall is flanged to an end of the outer peripheral wall of the drum and the inner peripheral wall connects the end walls.

13. The apparatus according to claim 11, wherein a space between the end walls is divided into the radial channels by radial walls.

* * * * *